US009545980B2

(12) United States Patent
Morimoto

(10) Patent No.: US 9,545,980 B2
(45) Date of Patent: Jan. 17, 2017

(54) ULTRA LARGE MARINE FLOATING SYSTEM

(71) Applicant: Nobuyoshi Morimoto, Tokyo (JP)

(72) Inventor: Nobuyoshi Morimoto, Tokyo (JP)

( * ) Notice: Subject to any disclaimer, the term of this patent is extended or adjusted under 35 U.S.C. 154(b) by 0 days.

(21) Appl. No.: 14/323,570

(22) Filed: Jul. 3, 2014

(65) Prior Publication Data

US 2015/0007763 A1 Jan. 8, 2015

(30) Foreign Application Priority Data

Jul. 3, 2013 (JP) ..... 2013-139540

(51) Int. Cl.
*B63B 25/16* (2006.01)
*B63B 25/08* (2006.01)

(52) U.S. Cl.
CPC ..... *B63B 25/16* (2013.01); *B63B 25/08* (2013.01); *B63B 2207/02* (2013.01)

(58) Field of Classification Search
CPC ..... B63B 25/16
USPC ..... 114/74
See application file for complete search history.

(56) References Cited

U.S. PATENT DOCUMENTS 2,940,268 A * 6/1960 Morrison ..... C10G 5/06 62/240
3,848,559 A * 11/1974 Tarossi ..... B63B 25/16 114/74 A
4,202,648 A * 5/1980 Kvamsdal ..... B63B 35/44 114/256
5,375,547 A * 12/1994 Abe ..... B63B 25/16 114/74 A
5,697,312 A 12/1997 Gustafsson et al.
6,546,739 B2 * 4/2003 Frimm ..... B63B 27/24 62/240
7,137,365 B2 11/2006 Maslen
8,375,875 B2 * 2/2013 Kim ..... B63B 27/24 114/74 R
8,375,876 B2 * 2/2013 Van Tassel ..... F17C 3/025 114/74 R
8,915,203 B2 * 12/2014 Greer ..... B63B 25/08 114/74 R
2010/0162939 A1 * 7/2010 Morimoto ..... B63B 25/16 114/74 R
2012/0108117 A1 5/2012 Kwon et al.
2014/0224169 A1 8/2014 Morimoto
(Continued)

FOREIGN PATENT DOCUMENTS

JP H1199988 A 4/1999
JP 2011219049 A 11/2011
(Continued)

*Primary Examiner* — Lars A Olson
*Assistant Examiner* — Jovon Hayes
(74) *Attorney, Agent, or Firm* — Muncy, Geissler, Olds & Lowe, P.C.

(57) ABSTRACT

A method to improve the safety and comfort of an ultra large marine floating system is provided. The ultra large marine floating system has a length of 350 to 550 m, a width of 45 to 80 m, and a depth of 25 to 35 m. The ultra large marine floating system has a tank zone and a plant zone that are visibly separated from one another. Additionally, the tank zone has LNG storage tanks, self-supporting spherical (MOSS type) tanks, a membrane tank arranged in a hold, and the plant zone includes a liquefied natural gas plant.

7 Claims, 3 Drawing Sheets

(56) References Cited

U.S. PATENT DOCUMENTS

| | | | | |
|---|---|---|---|---|
| 2015/0007763 | A1* | 1/2015 | Morimoto | B63B 25/16<br>114/74 T |

FOREIGN PATENT DOCUMENTS

| | | | |
|---|---|---|---|
| JP | 2011235675 | A | 11/2011 |
| JP | 2012-530010 | | 11/2012 |
| WO | WO 2013/024835 | A1 | 2/2013 |

* cited by examiner

ULTRA LARGE MARINE FLOATING SYSTEM

TECHNICAL FIELD

The present invention relates to an ultra large marine floating system and, in particular, to a large ship-shaped marine floating system. In more detail, the present invention relates to an ultra large marine floating system mounted with an LNG storage tank, a liquefied natural gas plant, a re-liquefied natural gas plant, an electricity supply plant, and an aluminum virgin ingot production plant, and an aluminum secondary ingot production plant.

BACKGROUND ART

When LNG is burned, the LNG produces a small amount of emission of nitrogen oxide and sulfurous acid gas and hence has been increasingly demanded as clean energy year by year. The LNG is produced by cooling natural gas to approximately −162° C. to thereby liquefy the natural gas and is carried by the sea to a consumption area by an LNG carrier.

Under circumstances where the price of energy is rising worldwide, development projects of a large-scale gas field of seabed far from land are currently beginning in earnest.

In the light of this trend, the following production and transportation system has been focused: that is, a marine floating system having a liquefied natural gas plant and an LNG storage tank arranged thereon is floated on the sea; in the marine floating system, the impurities of the natural gas are removed and the natural gas is liquefied to produce LNG and the LNG is stored in the tank; and when an LNG carrier arrives at the marine floating system, the LNG is offloaded (shipped off) from the LNG storage tank.

As compared with a case where a liquefied natural gas plant is constructed on the land, the transportation system has the following advantages: pipeline facilities from a gas field of seabed and in the sea to the land can be reduced; an environmental load can be reduced because development on the coast is not required; and workers can be comparatively easily secured because an LNG-FPSO is constructed in a country or a region different from those in which a gas field is developed and is towed to the site.

The LNG-FPSO (Floating LNG Production, Storage and Off-Loading system) used for this has the functions of liquefying gas, which is produced from a gas field of seabed, on the ocean to produce LNG, storing the LNG in a tank, and loading it onto an LNG carrier.

An LNG-FSRU (Floating LNG Storage and Re-gasification Unit) has a function of gasifying LNG received from an LNG carrier delivering the LNG gas to the land.

The LNG-FPSO include a tank or tanks for storing a large amount of produced LNG, and as its tank structure, LNG tank technology, which has been fostered in the construction of a conventional LNG carrier, is expected to be adopted. However, since how the LNG storage tank is used is different between the LNG-FPSO and the LNG carrier, care is needed. In the case of the LNG carrier, a phenomenon that a liquid cargo in the tank violently sloshes (sloshing phenomenon) is unlikely to occur even during heavy weather because the LNG storage tank is used either in full load condition or in unload condition and is never in half load condition. Only during cargo handling work, a liquid level in the tank greatly changes, but since the cargo handling work has been usually performed in a port where waves and winds are quiet, it has been possible to almost disregard the sloshing.

On the other hand, in the LNG-FPSO, the sloshing phenomenon is thought to be likely to occur because it is constantly moored on the ocean where a weather condition is severe and a liquid level in its LNG storage tank changes from time to time according to a production amount of LNG and a loading amount to the LNG carrier, and half load condition daily occurs.

Another important thing about the LNG-FPSO is that loading the liquid cargo to the LNG carrier with the use of a loading arm, a special hose with a coupling system or the like, by STS (ship to ship) operation, in particular, while the LNG carrier is alongside the LNG-FPSO (side by side), is now under consideration. Considering that the cargo handling for a conventional LNG carrier has been performed while the LNG carrier is moored at a berth provided in a safe port, it is thought that the aforesaid STS cargo handling on the ocean has a high risk caused by a collision accident occurs between the LNG-FPSO and the LNG carrier trying to approach it to damage the hull, or an accident such as the damage of the hull by leakage of the liquid cargo from the loading arm. Therefore, in designing the tank and ship of the LNG-FPSO, it is necessary to take such risks into full consideration.

Following three kinds of LNG storage tanks conventionally used in LNG carriers have been adopting, a self-supporting spherical tank (MOSS type tank), a self-supporting prismatic tank (SPB type), and a membrane tank and it is expected that one of these three tank types will be adopted also in the LNG-FPSO.

Regarding the self-supporting spherical tank, it is a self-supporting tank made of an aluminum alloy and is supported in a hold of a double hull construction, via a skirt extending from its equatorial portion. A thermal insulation layer is applied on an outer surface of the tank (external thermal insulation). Due to its spherical shape, the self-supporting spherical tank has a disadvantage of low volumetric efficiency because it is not well fitted in the hold. However, in the tank of this type, owing to its external thermal insulation, the thermal insulation layer does not suffer damage even by sloshing during heavy weather.

Regarding the self-supporting prismatic tank, a main body is a prismatic tank made of an aluminum alloy and longitudinal strength members reinforcing of the tank are provided on an inner side of the tank, and a thermal insulation layer is provided on an outer surface of the tank. This type requires void space between the prismatic tank and an inner hull of the ship, which accordingly reduces volumetric efficiency of the tank. On the other hand, since the longitudinal strength members can be provided inside the tank, sloshing of a liquid cargo does not easily occur during heavy weather, and even if the sloshing occurs, the thermal insulation layer provided on the outer surface of the tank is not damaged.

In the membrane tank, on an inner surface of a hold fabricated with a double hull structure, thin sheets (membranes) made of nickel steel or stainless steel are affixed, with a thermal insulation layer there between, to form a LNG tank. This type is excellent in volumetric efficiency because almost all the volume of the hold can be used as a tank volume. On the other hand, it has a disadvantage that the membranes and the thermal insulation layer are likely to be damaged by the sloshing of a liquid cargo. It also has a problem that a thermal insulation work, in particular, the welding of the membranes is complicated and it requires a long period for the construction.

CITATION LIST

Patent Literatures

Patent Literature 1: U.S. Pat. No. 5,697,312
Patent Literature 2: U.S. Pat. No. 7,137,365

SUMMARY OF INVENTION

Technical Problem

Several LNG-FPSOs are being constructed as far as the inventor knows. The LNG-FPSO includes not only an LNG storage tank but also a liquefied natural gas plant arranged therein and hence requires that special attention should be paid to safety.

As described above, in the LNG-FPSO, the sloshing phenomenon is thought to be likely to occur because it is constantly moored on the ocean where a weather condition is severe and a liquid level in its LNG storage tank changes from time to time according to a production amount of LNG and a loading amount to the LNG carrier, and half load condition daily occurs.

In addition, the workers are forced to continuously work for a long period on a marine floating system while they are affected by the weather, so that it is necessary to improve a working and living environment to the maximum.

Hence, a main objective of the present invention is to provide a marine floating system that solves the problems described above and that secures a more improvement in safety and comfort than a conventional LNG-FPSO and to use produced LNG effectively in a plant facility and an electric power supply facility.

Other problems will be made clear by the following descriptions.

Solution to Problem

The present invention to solve the problems described above is as follows.

<Invention as Claimed in Claim 1>

An invention as claimed in claim 1 is an ultra large marine floating system that has an ultra large marine floating structure with a length of 350 to 550 m, a width of 45 to 80 m, and a depth of 25 to 35 m, this ultra large marine floating system comprising: a tank zone having an LNG storage tank arranged in a hold; and a plant zone including a liquefied natural gas plant, wherein the tank zone and the plant zone are separated from each other in a plane view.

Further, it is preferable that a power facility zone and an accommodation area are separated in the plane view.

(Operation Effect)

Both of an LNG-FPSO and an LNG carrier need to take more measures against a sloshing phenomenon as compared with a conventional LNG carrier. Further, in the LNG-FPSO are provided not only an LNG storage tank but also plant facilities such as a liquefied natural gas plant, a re-liquefied natural gas plant, an electricity supply plant, an aluminum virgin ingot production plant, an aluminum secondary ingot production plant, and an iron scrap recycling plant, and other production plants, so that it is necessary to pay special attention to the safety of the LNG-FPSO. Furthermore, it is also necessary to improve the working and living environment of workers to the maximum.

In the present invention, the tank zone being the LNG storage tank arranged in the hold and the plant zone including the liquefied natural gas plant are separated from each other in the plane view. The best advantage of this arrangement, as described specifically later, is that this arrangement makes it possible to employ a structure improving safety.

When an ultra large marine floating system with a length of 350 to 550 m, a width of 45 to 80 m, and a depth of 25 to 35 m is constructed according to the present invention, various plants, units, and piping (these are referred to as "various kinds of equipment" in some cases) of the plant facilities can be arranged with spaces between them for safety. Further, when the various kinds of equipment are arranged in a planar arrangement, a resident gas accident caused by a difference in the specific gravity of gas can be minimized. Furthermore, the planar arrangement makes it easy to conduct the maintenance and inspection of the various kinds of equipment.

Although dangerous risk caused by the sloshing phenomenon is increased along with the marine floating system being made large, it is possible to take measures against the sloshing phenomenon by optimizing combination and arrangement of LNG tanks, by optimizing the arrangement of a ballast tank whose tank volume can be increased along with the marine floating system being made large, or by optimizing an operation of the ballast tank.

When the length and the width of the ultra large marine floating system are less than their lower limits, the system might be inferior in stability. Further, the ultra large marine floating system is large enough in the length, the width, and the depth, so that the ultra large marine floating system can easily secure a necessary storage tank space and a necessary plant space. On the other hand, when the ultra large marine floating system is excessively large in the length, the width, and the depth, the ultra large marine floating system creates a useless space and reaches a construction limit in size of a shipyard.

<Invention as Claimed in Claim 2>

An invention as claimed in claim 2 is an ultra large marine floating system as claimed in claim 1, wherein at least over the tank zone, is not arranged a plant facility for liquefying a natural gas other than a piping system for storing and offloading LNG.

(Operation Effect)

In order to exclude a possibility that gas which is lighter than, nearly equal to, or heavier than air in a specific gas gravity will come into the tank zone, at least over the tank zone, is not arranged the plant facility for liquefying the natural gas other than the piping system for storing and offloading LNG. In this way, the tank zone can be enhanced in safety.

<Invention as Claimed in Claim 3>

An invention as claimed in claim 3 is an ultra large marine floating system as claimed in claim 1 or claim 2, wherein at least the tank zone and the plant zone adjacent to the tank zone in a length direction are individually constructed by a system of constructing a plurality of blocks in a unit of length and then the tank zone and the plant zone are connected to each other in the length direction. In this case, it is preferable that the number of tanks in the tank zone is 1 to 5. Further, in the case where the tank zone has a plurality of tanks constructed therein, the plurality of tanks may be of the same type or may be of different types.

(Operation Effect)

The tank zone and the plant zone adjacent to the tank zone in the length direction can be constructed as separate floating structures. Hence, at least the tank zone and the plant zone adjacent to the tank zone in the length direction are constructed individually and concurrently in terms of time by the system of constructing a plurality of blocks in a unit of length and then the tank zone and the plant zone are connected to each other in the length direction by the use of the parallel bodies of their hulls. In this way, a total construction time can be made greatly short.

In the case where the ultra large marine floating system is constructed by the use of a conversion ship, a plant zone can be constructed by slightly converting a large-scale tanker or a large-scale ore carrier and can be connected to a new block of a tank zone, which is carefully constructed as a block. As a result, a drastic reduction in cost also can be achieved.

<Invention as Claimed in Claim 4>

An invention as claimed in claim 4 is an ultra large marine floating system as claimed in claim 1 or claim 2, wherein in a front part, the plant zone and a power facility zone are arranged, and in a rear part, the tank zone and an accommodation area are arranged and the accommodation area is located in a rearmost section in the rear part, and wherein the plant zone has a control room arranged on a deck in a rear portion thereof, the control room being a room in which at least, a crew, a monitoring person, and an operating person can visually observe or remotely monitor the plant zone, the tank zone, and the power facility zone.

(Operation Effect)

The tank zone and the plant zone are separated from each other and the control room, in which the crew can visually observe or remotely monitor the plant zone and the tank zone, is arranged at the boundary of the tank zone and the plant zone, so that the ultra large marine floating system can be enhanced in safety. In this regard, when the control room has a control device and an operating device for emergency arranged therein, the control room can be used not only simply as a monitoring room but also as an operation room.

Here, a sea level on the lee side is made stable because the marine floating system is large, so it is preferable that the tank zone vulnerable to the sloshing phenomenon is arranged in the rear.

<Invention as Claimed in Claim 5>

An invention as claimed in claim 5 is an ultra large marine floating system as claimed in claim 1, wherein the LNG storage tank is selected from a MOSS type tank, a membrane tank, or a self-supporting prismatic tank.

(Operation Effect)

The LNG storage tank can be selected from the MOSS type tank, the membrane tank, or the self-supporting prismatic tank, and a plurality of kinds of tanks can be arranged.

<Invention as Claimed in Claim 6>

An invention as claimed in claim 6 is an ultra large marine floating system as claimed in claim 1, wherein a transfer area to the outside is provided on a lee side of the marine floating system.

(Operation Effect)

A sea level on the lee side is made stable because the marine floating system is large, so that the loading of the liquefied natural gas in the LNG carrier in the mode of STS (ship to ship), the transfer of the goods, and the transfer of the crews can be conducted more safely.

(Operation Effect)

A term of "LNG ship" of the present invention is used in a wide meaning including a plant ship utilizing LNG such as an LNG carrier, an FLNG ship, an FSRU ship, and an SRV ship.

<Invention as Claimed in Claim 7>

An invention as claimed in claim 7 is an ultra large marine floating system as claimed in claim 1, wherein the plant zone includes not only the liquefied natural gas plant but also one or two or more additional facilities of a re-gasification facility, an electric power generation facility, an aluminum smelting facility and a scrap recycling facility of aluminum or iron.

(Operation Effect)

Since the ultra large marine floating system can utilize the inexpensive LNG stored in the LNG storage tank, the plant zone includes not only the liquefied natural gas plant but also one or two or more additional facilities of a re-gasification facility, an electric power generation facility, an aluminum smelting facility, and a scrap recycling facility of aluminum or iron. In this way, the ultra large marine floating system has a plant having various kinds of functions.

Advantageous Effects of Invention

As described above, according to the present invention, it is possible to provide a marine floating system securing better safety and comfort than a conventional LNG-FPSO.

DESCRIPTION OF EMBODIMENTS

Hereinafter, an embodiment of the present invention will be described with reference to the accompanied drawings.

Figure 1:
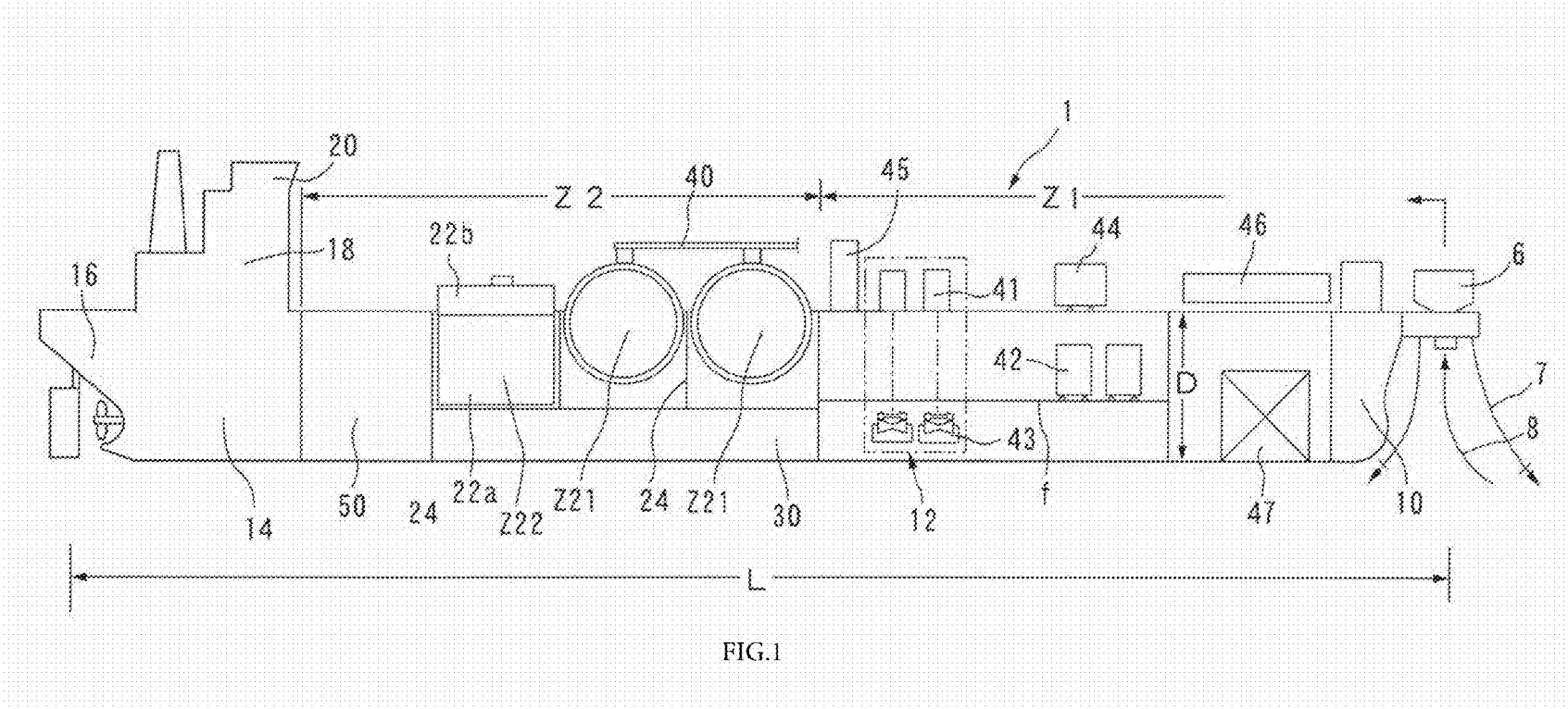
FIG. 1 is a front view of an LNG ship.
Figure 2:
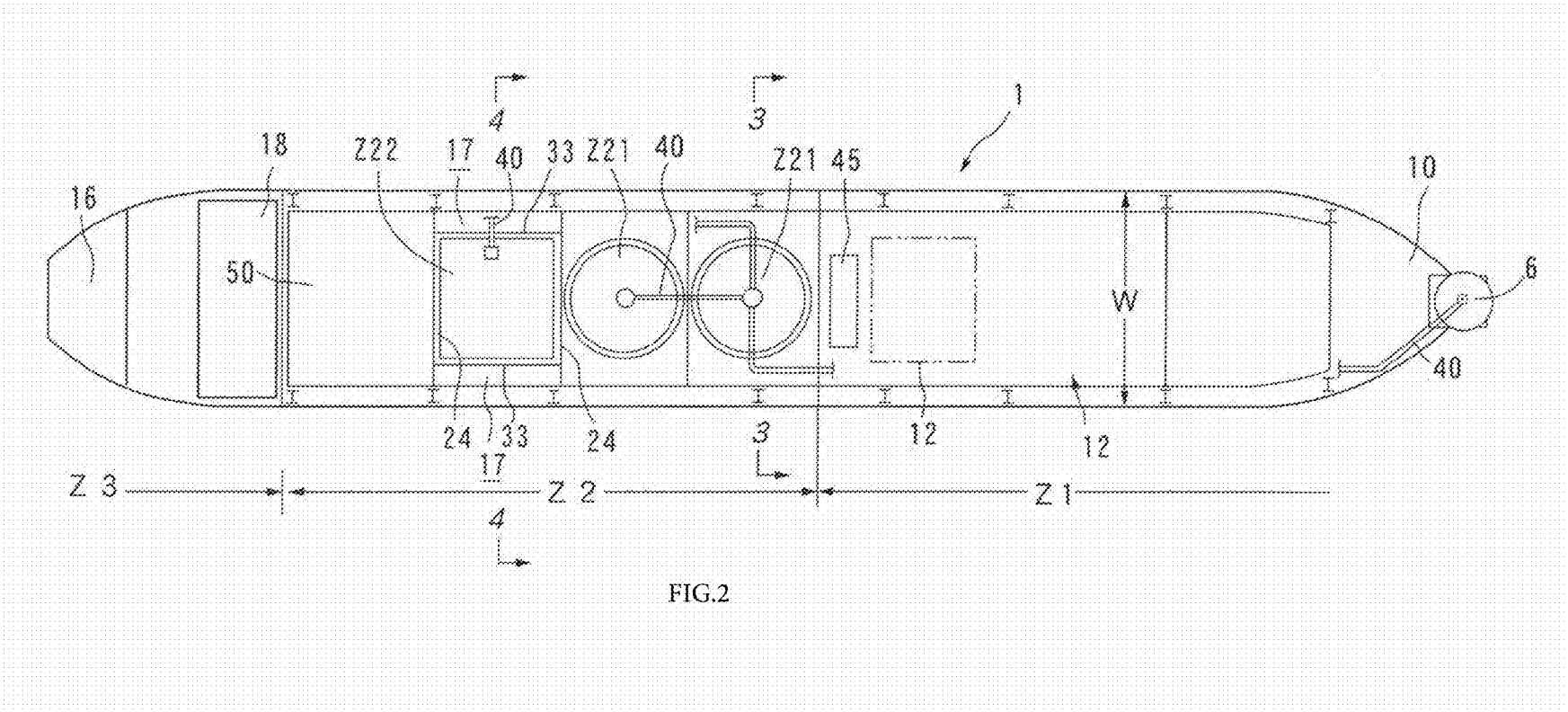
FIG. 2 is a plane view of an LNG ship.

As shown in FIG. 1 and FIG. 2, this FLNG system 1 includes a bow section 10, a plant zone Z1 including a liquefied natural gas plant 12, an LNG storage tank zone Z2 (in the illustration, this is divided into three self-supporting spherical (MOSS type) tanks Z21, Z21, Z21 and a membrane tank Z22), an engine room 14, and a stern section 16, which are connected to each other in this order from the front. An accommodation area 18 and a wheelhouse 20 are provided over the engine room. The tanks are partitioned into a plurality of sections by transfer bulkheads 24.

On a bow section 10, a turret 6 that is necessary for the LNG-FPSO is provided, and a mooring wire rope 7 extending from an anchor fixed to the seabed is connected to this turret to perform various kinds of works in a single-point mooring state. A riser pipe 8 rising from the seabed is also connected to the turret 6, and natural gas collected from a gas field is sent through this pipe 8 to the LNG storage tank zone Z2 on board.

In this regard, both of an external turret and an internal turret can be used for mooring and for acquiring the LNG.

The natural gas refined and liquefied by the liquefied natural gas plant 12 is sent to and stored in several LNG storage tanks provided in the LNG storage tank zone Z2. For the delivery of the stored LNG, an LNG carrier is set alongside the LNG-FPSO system 1 and a liquid cargo is loaded onto the LNG carrier by using a loading arm or a special hose (not shown in the drawing) provided on an upper deck.

Figure 3:
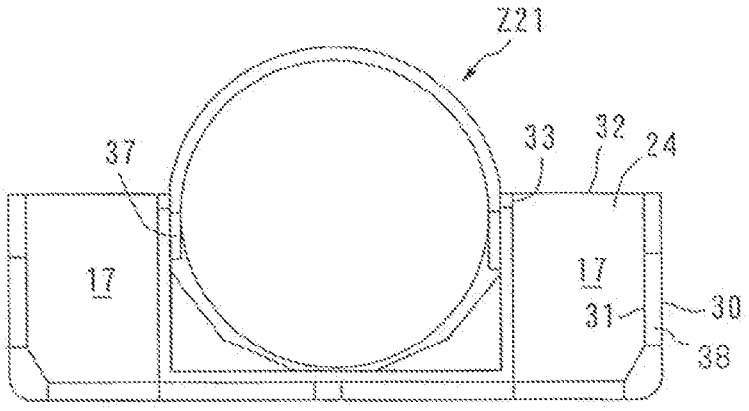
FIG. 3 is a view when viewed from arrow lines 3-3.
Figure 4:
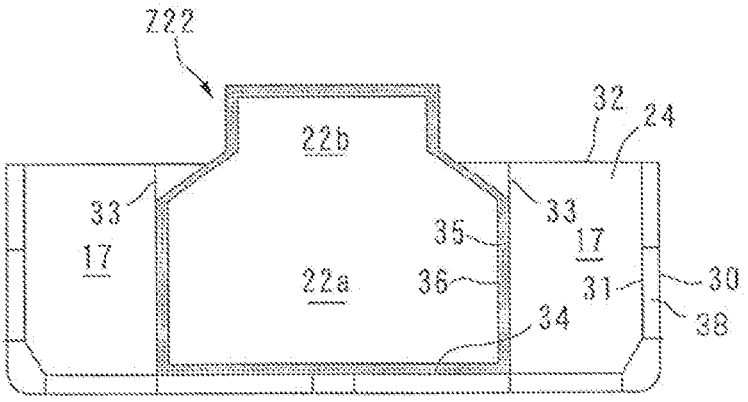
FIG. 4 is a view when viewed from arrow lines 4-4.

FIG. 3 and FIG. 4 are cross-sectional views of a center tank part of the LNG-FPSO, and a double hull structure composed of an outer hull 30 and an inner hull 31, which was included in the crude oil/ore carrier before its conversion, is used as it is, and a space 12 between the outer hull 30 and the inner hull 31 is used as a seawater ballast tank. A space surrounded by the inner hull 31 and the upper deck 32 is also partitioned into several sections by a pair of left and right longitudinal bulkheads 33 and several transfer bulkheads 24. Center-array sections formed between the left and right bulkheads 33 were originally holds for the crude oil and ore and by using these sections, several membrane LNG storage tanks 16 are formed. Left and right-array sections 17 (originally crude oil tanks) can be used as storage spaces of freshwater, condensate, a power facility and the like.

The membrane tank Z22 is composed of a main tank 22*a* under the deck and a box-shaped head tank 22*b* on the deck. When the ship was crude oil/ore carrier, a hatchway for loading ore was opened in the upper deck, and a hatch coaming stood to surround the hatchway. During conversion of the ship, a side wall is extended upward so as to be added to this hatch coaming and a ceiling is provided, whereby the head tank 22*b* is formed.

The head tank 22*b* formed in this manner communicates with a hole (originally the hatchway) opened in the deck to form one tank together with the main tank 22*a*.

The main tank 22*a* is formed by forming a double bottom 34 and a thermal insulation layer 35 on inner sides of the left and right longitudinal bulkheads 33, 33 and by liquid-tightly covering the top by a membrane 36 of invar or the like. The head tank 22*b* also has on its inner surface a thermal insulation layer 35 and a membrane 36.

The self-supporting spherical (MOSS type) tank Z21 is an independent tank, which has a spherical tank fixed to the hull by a cylindrical support structure 37 and, which supports the weight of LNG by the tank itself.

Returning to FIG. 1 and FIG. 2, at least over the LNG storage tank zone Z2, is not arranged a plant facility for liquefying natural gas other than a piping system 40 for storing and offloading LNG.

Further, a plant zone Z1 including the liquefied natural gas plant 12 has a cooling box 41, a gas boiler 42, a compressor and a turbine 43, and other units 44, 46 provided and arranged at specified positions, for example, in the hold and on the upper deck 32. A reference sign 47 designates an aluminum virgin ingot and secondary ingot production plant, and a reference sign 50 designates a power plant room.

In this case, when the plant zone Z1 has about one to three floors f provided under the upper deck 32 and has various units arranged on each of the floors f, the plant zone Z1 has the various units arranged separately, whereby the plant zone Z1 is enhanced in safety. Further, when the liquefied natural gas plants 12 are separately arranged on the left and right sides, for example, No. 1 liquefied natural gas plants 12 is arranged on the starboard side and No. 2 liquefied natural gas plant 12 is arranged on the port side, in the case where one of the liquefied natural gas plants 12 is stopped, by operating the other liquefied natural gas plant 12, the production can be continued without being interrupted.

The marine floating system described above can be constructed in the following manner: at least the tank zone and the plant zone adjacent to the tank zone in the length direction are individually constructed by a method of constructing a plurality of blocks in the unit of length; and then the tank zone and the plant zone are connected to each other in the length direction. In other words, the tank zone Z2 and the plant zone Z1 adjacent to the tank zone Z2 in the length direction are different from each other also in a construction method. Hence, at least the tank zone Z2 and the plant zone Z1 adjacent to the tank zone Z2 in the length direction are constructed individually and concurrently in terms of time by the method of constructing a plurality of blocks in the unit of length, and then the tank zone Z2 is connected to the plant zone Z1 in the length direction, whereby a total construction time can be significantly reduced.

If necessary, also a rearmost zone Z3 can be constructed separately and can be connected to the tank zone Z2.

It is desirable that a control room 45 in which a crew can visually observe and remotely monitor the plant zone and the tank zone is provided at a boundary in which the tank zone Z2 is separated from the plant zone Z1. This crew's monitoring can enhance safety. In this regard, when the control room has a control unit and an operation unit for emergency arranged therein, the control room can be used not only as a monitoring room but also as an operation room.

According to the present invention, the marine floating system is large and hence a sea level on the lee side is more stable, thus it is preferable that the tank zone vulnerable to a sloshing phenomenon is arranged not in the front but in the rear. Further, the loading of the liquefied natural gas in the LNG carrier (STS (ship to ship)), the transfer of the goods, and the transfer of the crews can be conducted in the rear portion of the marine floating system 1.

In this regard, the length L, the width W, and the depth D of the marine floating system 1 are determined as shown in the drawings.

The above embodiment can be employed further in combination as required.

INDUSTRIAL APPLICABILITY

The present invention can be applied to an FLNG ship (LNG-FPSO (Floating Production, Storage and Off-Loading system)), an FSRU ship, and an SRV ship.

The LNG ship of the present invention includes a re-gasification unit and the examples of the re-gasification unit are an FSRU (Floating Storage and Re-gasification Unit) and an SRV (Shuttle and Re-gasification Vessel). The FSRU is mounted with a re-gasification unit and fixes a ship having an LNG storage capacity on the sea and receives LNG from the other LNG ship. The natural gas re-gasified by the FSRU is sent out to a pipeline on the land. The SRV does not transfer LNG from the other LNG ship but transports LNG loaded in at a liquefaction base to a demand area, re-gasifies the LNG on the deck, and sends out the re-gasified natural gas to a pipeline on the land.

REFERENCE SIGNS LIST

1 . . . FLNG (LNG-FPSO) system
6 . . . Turret
10 . . . Bow section
12 . . . Liquefied natural gas plant
14 . . . Engine room
16 . . . Stem section
17 . . . Sections in row
18 . . . Accommodation area
20 . . . Wheelhouse
Z21 . . . Self-supporting spherical (MOSS type) tank
Z22 . . . Membrane tank
24 . . . Transfer bulkhead
30 . . . Outer hull
31 . . . Inner hull
33 . . . Longitudinal bulkhead
45 . . . Control room
Z1 . . . Plant zone
Z2 . . . LNG storage tank zone
L . . . Length
W . . . Width
D . . . Depth

The invention claimed is:

1. An ultra large marine floating system that has an ultra large marine floating structure with a length of 350 to 550 m, a width of 45 to 80 m, and a depth of 25 to 35 m, the ultra large marine floating system comprising:

a tank zone having an LNG storage tank arranged in a hold; and a plant zone including a liquefied natural gas plant, wherein the tank zone and the plant zone are separated from each other such that entire plant zone is not located in the tank zone and is not arranged above the tank zone.

2. The ultra large marine floating system as described in claim 1, wherein a plant facility for liquefying a natural gas, other than a piping system for storing and offloading LNG, is not arranged in the tank zone and is not arranged above the tank zone.

3. The ultra large marine floating system as described in claim 1, wherein at least the tank zone and the plant zone adjacent to the tank zone in a length direction are individually constructed by a system of constructing a plurality of blocks in a unit of length and then the tank zone and the plant zone are connected to each other in the length direction.

4. The ultra large marine floating system as described in claim 1, wherein in a front part, the plant zone and a power facility zone are arranged and in a rear part, the tank zone and an accommodation area are arranged and the accommodation area is located in a rearmost section in the rear part, and wherein the plant zone of the front part has a control room arranged on a deck in a rear portion of the plant zone of the front part, the control room being a room in which at least, a crew can visually observe or remotely monitor the plant zone, the tank zone and the power facility zone.

5. The ultra large marine floating system as described in claim 1, wherein the LNG storage tank is selected from a self-supporting spherical tank, a membrane tank, or a self-supporting prismatic tank.

6. The ultra large marine floating system as described in claim 1, wherein a transfer area to the outside is provided on a lee side of the marine floating system.

7. The ultra large marine floating system as described in claim 1, wherein the plant zone includes not only the liquefied natural gas plant but also one or two or more additional facilities of a re-gasification facility, an electric power generation facility an aluminum smelting facility and a scrap recycling facility of aluminum or iron.

* * * * *